US005440489A

United States Patent [19]

Newman

[11] Patent Number: 5,440,489

[45] Date of Patent: Aug. 8, 1995

[54] REGULATING A RAILWAY VEHICLE

[75] Inventor: Gregory D. Newman, Chippenham, United Kingdom

[73] Assignee: Westinghouse Brake & Signal Holdings Ltd., United Kingdom

[21] Appl. No.: 6,456

[22] Filed: Jan. 21, 1993

[30] Foreign Application Priority Data

Feb. 6, 1992 [GB] United Kingdom ..... 9202520

[51] Int. Cl.[6] ..... G06F 165/00

[52] U.S. Cl. ..... 364/426.05; 364/436; 340/994

[58] Field of Search ..... 364/426.01, 426.05, 364/436, 461; 340/991-994; 246/2 R, 3, 5

[56] References Cited

U.S. PATENT DOCUMENTS

| | | | |
|---|---|---|---|
| 4,093,161 | 6/1978 | Auer, Jr. | 364/436 |
| 4,122,523 | 10/1978 | Morse et al. | 364/436 |
| 4,179,739 | 12/1979 | Virnot | 364/426.05 |
| 4,181,943 | 1/1980 | Mercer, Sr. et al. | 364/436 |
| 4,220,946 | 9/1980 | Henriot | 340/994 |
| 4,791,571 | 12/1988 | Takahashi et al. | 364/436 |
| 4,799,162 | 1/1989 | Shinkawa et al. | 364/436 |
| 5,177,684 | 1/1993 | Harker et al. | 364/461 |
| 5,239,472 | 8/1993 | Long et al. | 364/426.05 |

FOREIGN PATENT DOCUMENTS

| | | |
|---|---|---|
| 0341826 | 11/1989 | European Pat. Off. . |
| 1605862 | 1/1968 | Germany . |
| 3213459 | 9/1991 | Japan . |
| 1321053 | 6/1973 | United Kingdom . |
| 1321054 | 6/1973 | United Kingdom . |
| WO9003622 | 4/1990 | WIPO . |

*Primary Examiner*—Gary Chin
*Attorney, Agent, or Firm*—Welsh & Katz, Ltd.

[57] ABSTRACT

Apparatus for use in a railway vehicle for regulating it, comprising: means for calculating running profiles between two or more fixed destinations; means for receiving, either from a second or subsequent railway vehicle, directly or via separate means, the time at which one or more of the destinations will become clear for use by the railway vehicle; means for knowing what balance to apply to trade-offs between two or more operational strategies; means for knowing the timetabled arrival and departure times scheduled for it at any destination; and means for reporting to any second or subsequent railway vehicle, either directly or via separate means, its calculated arrival time at any destination.

5 Claims, 3 Drawing Sheets

*One of several ways of achieving minimum headway dependent on journey time subject to simulations.

REGULATING A RAILWAY VEHICLE

BACKGROUND OF THE INVENTION

The present invention relates to regulating a railway vehicle.

The problem of railway vehicle regulation is a system-wide problem but can be considered as being the sum of a large number of single journeys for each individual vehicle in a railway. In overall terms, it amounts to a balance between the cost of running railway vehicles and providing a service considered as acceptable to the public. A service which is generally regarded as acceptable is one which provides frequent railway vehicles (i.e. with short headways) as well as short journey times, and these are conflicting requirements.

The trade-off between these two requirements is simple on a plain line track with equally spaced stations, but real railways are not like this. The present invention aims to provide means to overcome the problems associated with railway vehicle regulation on non-ideal railways.

Systems exist at present where running profiles are predefined at the signalling system design stage. These systems offer only two different running profiles, one providing minimum journey time and one providing power savings utilising coasting, which increases journey time by a fixed percentage (usually chosen to be between 5% and 10%). It is possible to select between these profiles but they cannot be changed without considerable effort since they are "hard wired" typically in programmable read-only memories. Special station approach profiles can also be configured at the design stage but these generally provide only one crudely defined approach profile at a lower than usual speed. This speed is either implemented as a permanent speed restriction through a station (which delays railway vehicles unnecessarily on clear track) or as a selectable reduction in target speed (which is chosen from a limited range of available target speeds) on the approach to a station.

It is known that there are many different speed profiles which can be adopted in order for a railway vehicle to travel between two points on a track. There are three characteristics of such profiles that are important in the transport industry. They are "journey time" (how long it takes to get from one place to another), "headway" (the time interval between one railway vehicle and the next) and "power consumption" (how much energy is used in the Journey).

By the nature of physics relating to a journey, optimising all three of these at once is not possible. Curves representing an optimised running profile for each of these are shown in FIG. 1.

Each curve can be described in the following way:

i) For "Minimum Journey Time", the profile uses maximum acceleration and maximum service braking between maximum safe speed (as defined by permanent and temporary speed restrictions) and stopping points (either station stops or limits of movement authority).

ii) For "Best Power Consumption", the profile uses maximum acceleration to maximum line speed and then coasts at some point. It approaches the station stop using maximum service braking.

iii) For "Minimum Headway", the profile uses maximum acceleration to maximum line speed, approaches all speed restrictions using maximum service braking and adopts a special shallow approach to the limit of its movement authority or required stopping point (e.g. station). The actual form of the station approach is the subject of simulation studies.

The fine details of these profiles depend on things such as the length of the railway vehicle, the braking and acceleration capabilities of the railway vehicle and any speed restrictions applying to the railway vehicle. These are different for each type of railway vehicle and it is logical to enable each railway vehicle to have information relating to these characteristics.

SUMMARY OF THE INVENTION

According to the present invention, there is provided apparatus for use in a railway vehicle for regulating it, comprising: means for calculating running profiles between two or more fixed destinations; means for receiving, either from a second or subsequent railway vehicle, directly or via separate means, the time at which one or more of the destinations will become clear for use by the railway vehicle; means for knowing what balance to apply to trade-offs between two or more operational strategies; means for knowing the timetabled arrival and departure times scheduled for it at any destination; and means for reporting to any second or subsequent railway vehicle, either directly or via separate means, its calculated arrival time at any destination.

BRIEF DESCRIPTION OF THE DRAWINGS

The present invention will now be described by way of example, with reference to the Figures of the accompanying drawings, in which.

DETAILED DESCRIPTION OF THE PREFERRED EMBODIMENTS

Figure 1:
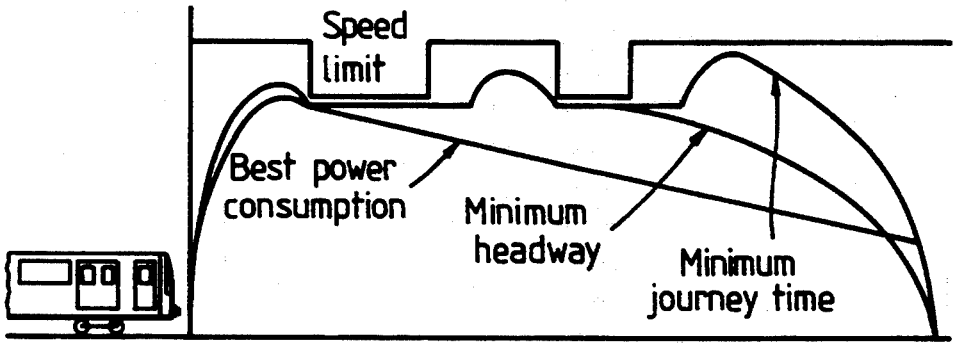
FIG. 1 shows different optimized running profiles.
Figure 2:
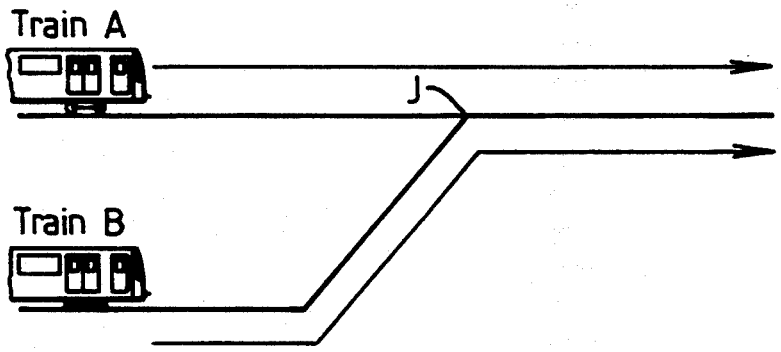
FIG. 2 shows two trains approaching a junction.

A problem the example of the present invention overcomes will first be described. Difficulties arise in regulating a train service when junctions are encountered or delays in a service are experienced or when the maximum amount of performance is required from an existing system. With reference to FIG. 2, a timetable would allow a train A to pass through a junction J first and for a train B to follow, without train B needing to be checked. However, if it is supposed that train A is running late, a decision must be made based on knowledge of the state of the entire railway as to which train goes first through the junction J.

The situation has two solutions:

1) Allow train A to go first, causing train B to brake and hence be delayed;

or

2) Allow train B to go first and hence possibly delay train A even further.

If solution 1 is chosen, there is an advantage to be gained in terms of power saving and favourable passenger perception if train B travels more slowly towards the junction J to arrive just as the route through the junction becomes available rather than driving as fast as possible towards the junction and then having to brake and wait for the junction to become clear only to then re-accelerate to continue to its journey. To be able to do this, train B must know when train A is due to clear the junction J. This assumption is based on the anticipated speed of train A up to the junction J or its reported time of arrival at its destination. Train B may get this information directly from train A or via a central control.

If train B can be told when the junction J is expected to become clear, then it can calculate a running profile that will ensure it will arrive at the earliest possible moment but without having to brake unnecessarily. This will define a journey time for train B from its present location to the junction.

Figure 3:
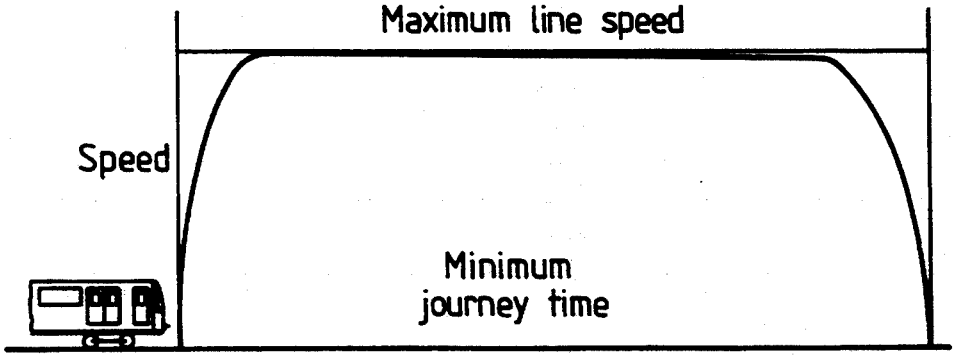
FIGS. 3, 4 and 5 show minimum journey time, best power consumption and minimum headway profiles respectively for a train, in terms of speed with respect to distance.

If the journey time required is equal to or less than the best journey time as calculated by train B, then train B will calculate a curve using maximum acceleration, maximum line speed and maximum service braking which in the simplest case is as in FIG. 3.

If the required journey time is less than the best achievable time, then train B will notify its best achievable journey time so that other trains may adjust their running as necessary.

The required journey time may be greater than its minimum possible journey time. If it is, there is scope for train B to alter its running profile to optimise other parameters such as power consumption or headway.

Figure 4:
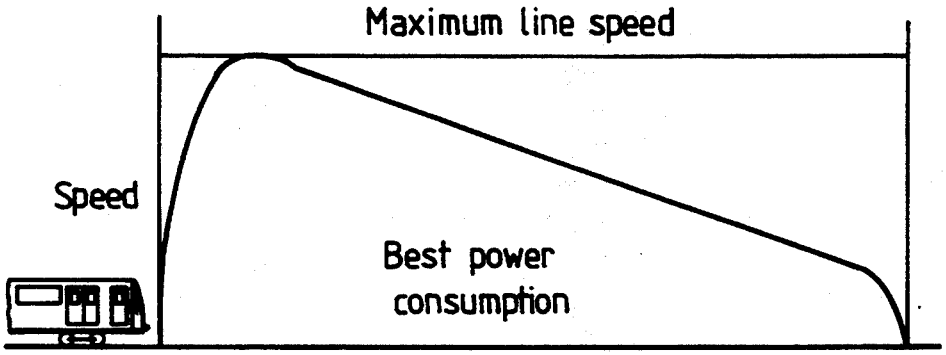

Should the optimisation of power consumption be specified, then train B can calculate a running profile that achieves the required journey time but reduces the power consumption for the total journey. Such a running profile in the simplest case is shown in FIG. 4.

Figure 5:
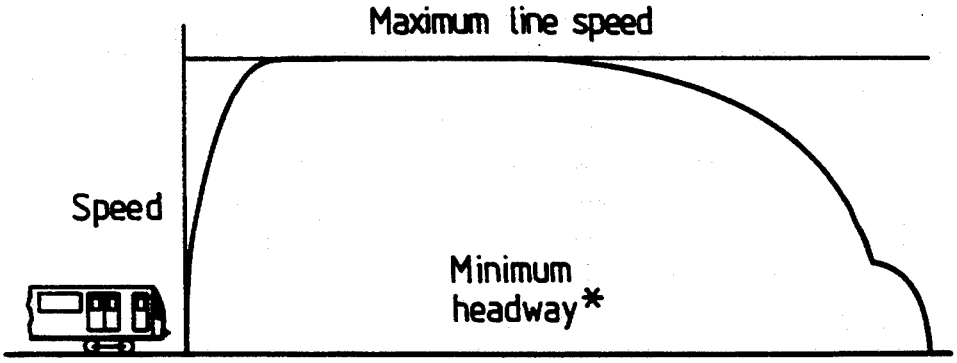

Should the optimisation of headway be specified, then train B can calculate a running profile that achieves the required journey time but reduces the headway between train B and the clearance of the junction by train A. Such a running profile in the simplest case is shown in FIG. 5.

In the absence of any specified primary optimisation parameter, a default strategy may be invoked thereby implementing a largely self-regulating train.

In an example of a system according to the present invention, there would be a central regulation unit making decisions about the required arrival and departure times of every train on the railway, a communications system which allows information to pass between every train and this central regulation unit and a unit on board every train which calculates distance/velocity profiles on the basis of information supplied to it by the central regulation unit and which controls the train's traction and braking systems in order to drive to the calculated profile for the particular point-to-point journey.

Figure 6:
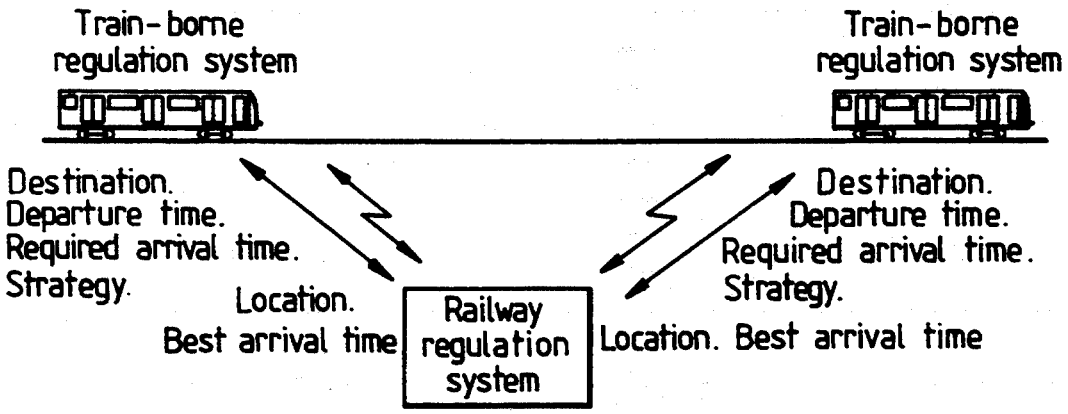
FIG. 6 is a schematic representation of a system according to an example of the present invention.

The overall arrangement is shown in FIG. 6.

The central regulation unit in a railway regulation system, in making its decisions, will need to have knowledge of the timetable and the current state of the railway in order to calculate the required arrival time of a particular train at a particular control point on the railway. (A control point may be a station, the approach point to a junction, or some similar location critical to the regulation of a railway).

The required arrival time of a particular train at a particular control point is the latest of:- a) the timetabled arrival time and b) the anticipated departure/-clearance time of the train currently holding the control point. (A train may be said to be holding a control point if it is co-located with or is the first train chosen to approach a control point). The anticipated arrival time of a train at a control point may be reported by that approaching train or deduced by the central regulation unit from the rate of change in a trains reported position (approach velocity) and the distance still to travel to the control point.

The strategy for a train's journey may be determined by rules laid down by the railway operator but may be of the following form:

Specify power saving (i.e. coasting) if there are no disruptions in the vicinity of the train.

Specify headway optimisation if the train in front of the train in question is running late.

The railway operator may also lay down rules which specify a particular balance of power saving during the journey and headway improvement at the approach to the control point.

Figure 7:
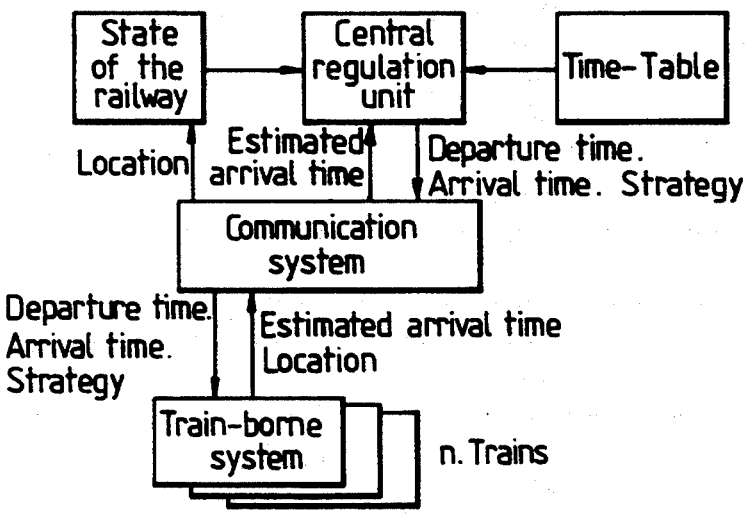
FIG. 7 is a block diagram of elements of the system.

The relevant elements of the central regulation unit are shown shaded in FIG. 7.

Figure 8:
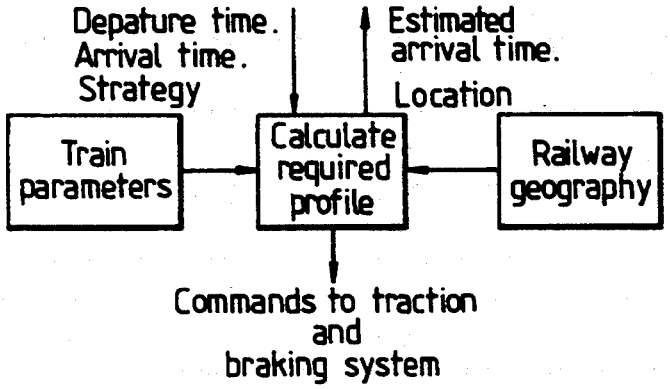
FIG. 8 is a block diagram of elements of a train-borne part of the system.

The relevant items of the train carried unit are shown in FIG. 8.

Once the train has received its arrival time, departure time and strategy for the journey, it will calculate a running profile for the journey using knowledge of its own performance characteristics and route geography., (Route geography in this case includes speed restrictions, gradients and curves). If it cannot achieve the required arrival time it will report its best arrival time to the central regulation unit so that alternative strategies for the railway can be formulated.

Having done this, it will then drive the journey according to the profile until the destination is reached. The process is then repeated.

I claim:

1. Apparatus for use in a first railway vehicle for regulating said vehicle, the apparatus comprising:

calculating means for calculating running profiles of distance with respect to velocity among a plurality of fixed locations;

first receiving means for receiving the time at which at least one of the fixed locations will become clear for use by said first railway vehicle;

second receiving means for receiving the timetabled arrival and departure times scheduled for said first railway vehicle at any of said fixed locations;

means for controlling the calculation by said calculating means of a calculated running profile on the basis of the information received by the first and second receiving means by selecting and optimizing one of journey time, power consumption and inter-vehicle headway;

said calculating means further calculating an arrival time of said first railway vehicle;

means for operating the traction and braking system of said first vehicle for use in driving said first vehicle to the calculated running profile; and means for reporting to a second railway vehicle the calculated arrival time of said first vehicle at any of said fixed locations.

2. A railway vehicle regulation system including first and second railway vehicles, wherein each of said vehicles includes apparatus for regulating the respective railway vehicle, the apparatus including:

calculating means for calculating running profiles of distance with respect to velocity among a plurality of fixed locations;

first receiving means for receiving the time at which at least one of the fixed locations will become clear for use by the respective railway vehicle;

second receiving means for receiving the time tabled arrival and departure times scheduled for the respective railway vehicle at any of said fixed locations;

means for controlling the calculation by said calculating means of a calculated running profile on the basis of the information received by the first and second receiving means by selecting and optimizing one of journey time, power consumption and inter-vehicle headway;

said calculating means further calculating an arrival time of one of said first and second railway vehicle;

means for operating the traction and braking system of the respective railway vehicle for use in driving the respective vehicle to the calculated running profile; and means for reporting to the other of said first and second railway vehicles the calculated arrival time of the respective vehicle at any of said fixed locations.

3. A system according to claim 2, wherein the first receiving means receives the time at which at least one of the fixed locations will become clear for use from the other of said first and second railway vehicles.

4. A system according to claim 2, wherein the first receiving means receives the time at which at least one of the fixed locations will become clear for use from a central regulation unit of the system.

5. A system according to claim 2, wherein the reporting means reports the calculated arrival time directly to the other of said first and second railway vehicles.

* * * * *